US010808413B2

(12) United States Patent
Colino Vega

(10) Patent No.: US 10,808,413 B2
(45) Date of Patent: Oct. 20, 2020

(54) VERTICAL FORMWORK AND AN ANCHOR FOR A VERTICAL FORM WORK

(71) Applicant: ULMA C y E, S. Coop., Oñati (ES)

(72) Inventor: Manuel Colino Vega, Vitoria-Gasteiz (ES)

(73) Assignee: ULMA C Y E, S. COOP., Oñati (ES)

( * ) Notice: Subject to any disclaimer, the term of this patent is extended or adjusted under 35 U.S.C. 154(b) by 0 days.

(21) Appl. No.: 16/590,990

(22) Filed: Oct. 2, 2019

(65) Prior Publication Data

US 2020/0032532 A1 Jan. 30, 2020

Related U.S. Application Data

(63) Continuation of application No. PCT/ES2018/070247, filed on Mar. 27, 2018.

(30) Foreign Application Priority Data

Apr. 6, 2017 (EP) ..... 17382180

(51) Int. Cl.
*E04G 17/065* (2006.01)

(52) U.S. Cl.
CPC ..... *E04G 17/0652* (2013.01); *E04G 17/0651* (2013.01)

(58) Field of Classification Search
CPC ... E04G 17/06; E04G 17/065; E04G 17/0651; E04G 17/0652; E04G 17/0654;
(Continued)

(56) References Cited

U.S. PATENT DOCUMENTS 1,850,402 A * 3/1932 Lampert ..... E04G 17/0742 249/219.1
1,935,218 A * 11/1933 Umbach ..... E04G 17/0658 249/190

(Continued)

FOREIGN PATENT DOCUMENTS

DE 1803299 A1 10/1969
DE 3841023 A1 6/1990

(Continued)

OTHER PUBLICATIONS

International Search Report and Written Opinion in corresponding International Application No. PCT/ES2018/070247, dated Jul. 10, 2018, 12 pages.

(Continued)

*Primary Examiner* — Michael Safavi
(74) *Attorney, Agent, or Firm* — Edell, Shapiro & Finnan, LLC

(57) ABSTRACT

Anchor assembly for a vertical formwork that according to one embodiment includes a front anchor element and a tie rod having a first end that is housed in the front anchor element. The front anchor element and the first end of the tie rod are configured for fixing the front anchor element in different axial positions of the first end of the tie rod, such that when the tie rod is arranged in a fitting angular position it can move axially with respect to the front anchor, and when the tie rod is arranged in a fixing angular position the tie rod cannot move axially with respect to the front anchor. According to some embodiments the front anchor element also includes blocking means configured for blocking the rotation of the tie rod when it is arranged in the fixing angular position.

20 Claims, 10 Drawing Sheets

(58) Field of Classification Search
CPC ..... E04G 17/0655; E04G 17/0657; E04G 17/0658; F16B 21/02; F16B 43/001
USPC ..... 249/40, 42, 43
See application file for complete search history.

(56) References Cited

U.S. PATENT DOCUMENTS 2,001,052 A * 5/1935 Colt ..... E04G 17/0742 249/217
2,002,526 A * 5/1935 Colt ..... E04G 17/0658 249/217
2,004,462 A * 6/1935 Bush ..... E04G 11/12 249/42
2,069,085 A * 1/1937 Day ..... E04G 17/0652 249/42
2,116,597 A * 5/1938 Colt ..... E04G 17/0658 249/217
2,162,869 A * 6/1939 Symons ..... E04G 17/0658 249/42
2,270,035 A * 1/1942 Colt ..... E04G 17/0658 249/42
2,270,448 A 1/1942 Juhl
2,281,833 A * 5/1942 De Canio ..... E04G 17/0658 249/217
2,491,460 A * 12/1949 Turzillo ..... E04G 17/0658 249/42
2,502,672 A * 4/1950 Roother ..... E04G 17/0657 249/217
2,523,131 A * 9/1950 Martin ..... E04G 11/10 249/42
2,659,125 A * 11/1953 Williams ..... E04G 17/0658 249/42
3,168,772 A * 2/1965 Williams ..... E04G 17/0652 249/42
3,198,476 A * 8/1965 Smith ..... E04G 17/0752 249/42
3,292,893 A * 12/1966 Williams ..... E04G 17/0658 249/42
3,415,484 A * 12/1968 Klaiss ..... E04G 17/0658 249/216
3,667,720 A * 6/1972 Williams ..... E04G 17/0658 249/213
3,910,546 A * 10/1975 Connors ..... E04G 17/0721 249/40
3,981,476 A * 9/1976 Alexander ..... E04G 17/0658 249/42
4,044,986 A * 8/1977 Strickland ..... E04G 17/0657 249/216
6,935,607 B2 * 8/2005 Ward ..... E04G 17/045 249/190
8,220,772 B2 * 7/2012 Schwoerer ..... E04G 17/0657 249/40
2004/0079860 A1 * 4/2004 Ward ..... E04G 17/045 249/33
2008/0173788 A1 * 7/2008 Brewka ..... E04G 11/10 249/189
2012/0304570 A1 * 12/2012 Braun ..... E04G 17/0657 52/426
2014/0374568 A1 * 12/2014 Amon ..... E04G 7/32 249/1
2015/0167329 A1 * 6/2015 Hagemes ..... E04G 11/08 52/745.21
2017/0002575 A1 * 1/2017 Dingier ..... E04G 17/14
2018/0320393 A1 * 11/2018 Dingier ..... E04G 17/0657

FOREIGN PATENT DOCUMENTS

EP 2060703 A1 5/2009
EP 2816175 A1 12/2014
FR 2232217 * 12/1974 ..... E04G 17/0652
GB 1260743 A 1/1972
JP S4939778 B1 10/1974

OTHER PUBLICATIONS

Extended European Search Report in corresponding EP Application No. 17382180.2, dated Sep. 8, 2017, 6 pages.

* cited by examiner

VERTICAL FORMWORK AND AN ANCHOR FOR A VERTICAL FORM WORK

CROSS-REFERENCE TO RELATED APPLICATIONS

This application relates to and claims the benefit and priority to International Application No. PCT/ES2018/070247, filed Mar. 27, 2018, which relates to and claims the benefit and priority to European Application No. EP17382180.2, filed Apr. 6, 2017.

TECHNICAL FIELD

The present invention relates to an anchor assembly for a vertical formwork and to a vertical formwork.

BACKGROUND

Vertical formworks are known to be used for building vertical structures, such as walls, for example. A vertical formwork comprises two formwork panels which are arranged facing and fixed to one another by means of a tie rod, the tie rod being fixed to the formwork panels by means of an anchor fixed to the respective formwork panel.

The same tie rod can be used to build walls with varying thicknesses. To that end, the front anchor is known to allow being arranged in different axial positions of a first end of said tie rod.

EP2816175A1 discloses a vertical formwork with a wall thickness adjustment system comprising a tie rod with a first end with a plurality of grooves and a retaining element comprising two pivoting halves coupled to one another and forming a housing with a plurality of grooves engaging with the grooves of the tie rod. The retaining element is introduced in a housing of the front anchor and is retained in said housing by means of an elastic element.

EP2060703A1 discloses an anchor assembly for a vertical formwork. The anchor assembly comprises a front anchor element, and a tie rod comprising a first end which is housed in said front anchor element. The front anchor element and the first end of the tie rod are configured for fixing said front anchor element in different axial positions of the first end of the tie rod. The first end of the tie rod comprises a plurality of holes and the anchor comprises a pin that is slidable between a release position, in which the pin is not housed in any of said holes of the first end of the tie rod and therefore the anchor can move axially with respect to said first end of the tie rod, and a blocking position in which the pin is housed in one of the holes of the first end of the anchor and therefore the anchor is fixed to the first end of the tie rod.

DE1803299A1 discloses an anchor assembly for a vertical formwork, said anchor assembly comprising a front anchor element, and a tie rod comprising a first end which is housed in said front anchor element. The first end of the tie rod comprises two grooved faces, more specifically two threaded faces, and two planar faces. The two threaded faces of the first end of the tie rod are screwed into the front anchor element, and the front anchor element can be fixed in different axial positions of the first end of the tie rod.

SUMMARY

A first aspect of the invention relates to an anchor assembly for a vertical formwork. Said anchor assembly comprises a front anchor element, and a tie rod comprising a first end which is housed in said front anchor element, the front anchor element and the first end of the tie rod being configured for fixing said front anchor element in different axial positions of the first end of the tie rod.

The front anchor element comprises a fitting part comprising a housing in which the first end of the tie rod is arranged, the housing of the fitting part comprising at least one grooved face. The first end of the tie rod comprises at least one grooved face and at least one planar face.

When the tie rod is arranged in a fitting angular position, in which the planar face of the tie rod and the grooved face of the fitting part are arranged facing one another, the tie rod can move axially with respect to the fitting part.

When the tie rod is arranged in a fixing angular position, in which the grooved face of the tie rod and the grooved face of the fitting part engage with one another, the tie rod cannot move axially with respect to the fitting part.

The front anchor element also comprises blocking means configured for blocking the rotation of the tie rod with respect to the fitting part when the tie rod is arranged in the fixing angular position.

A second aspect of the invention relates to a vertical formwork comprising a front formwork panel and a rear formwork panel which are arranged facing one another, an anchor assembly with the features described above fixed to the front formwork panel, and a rear anchor fixed to the rear formwork panel and fixed to a threaded end of the tie rod of the anchor assembly.

The combination of the grooved face of the fitting part and the planar face and the grooved face of the first end of the tie rod provides a fast and comfortable wall thickness adjustment system based on three simple movements consisting of a first rotation of the tie rod to position it in the fitting angular position, axial movement of the front anchor element to the desired position, and a second rotation of the tie rod to position it in the fixing angular position.

These and other advantages and features will become apparent in view of the drawings and detailed description.

DETAILED DESCRIPTION

Figure 1:
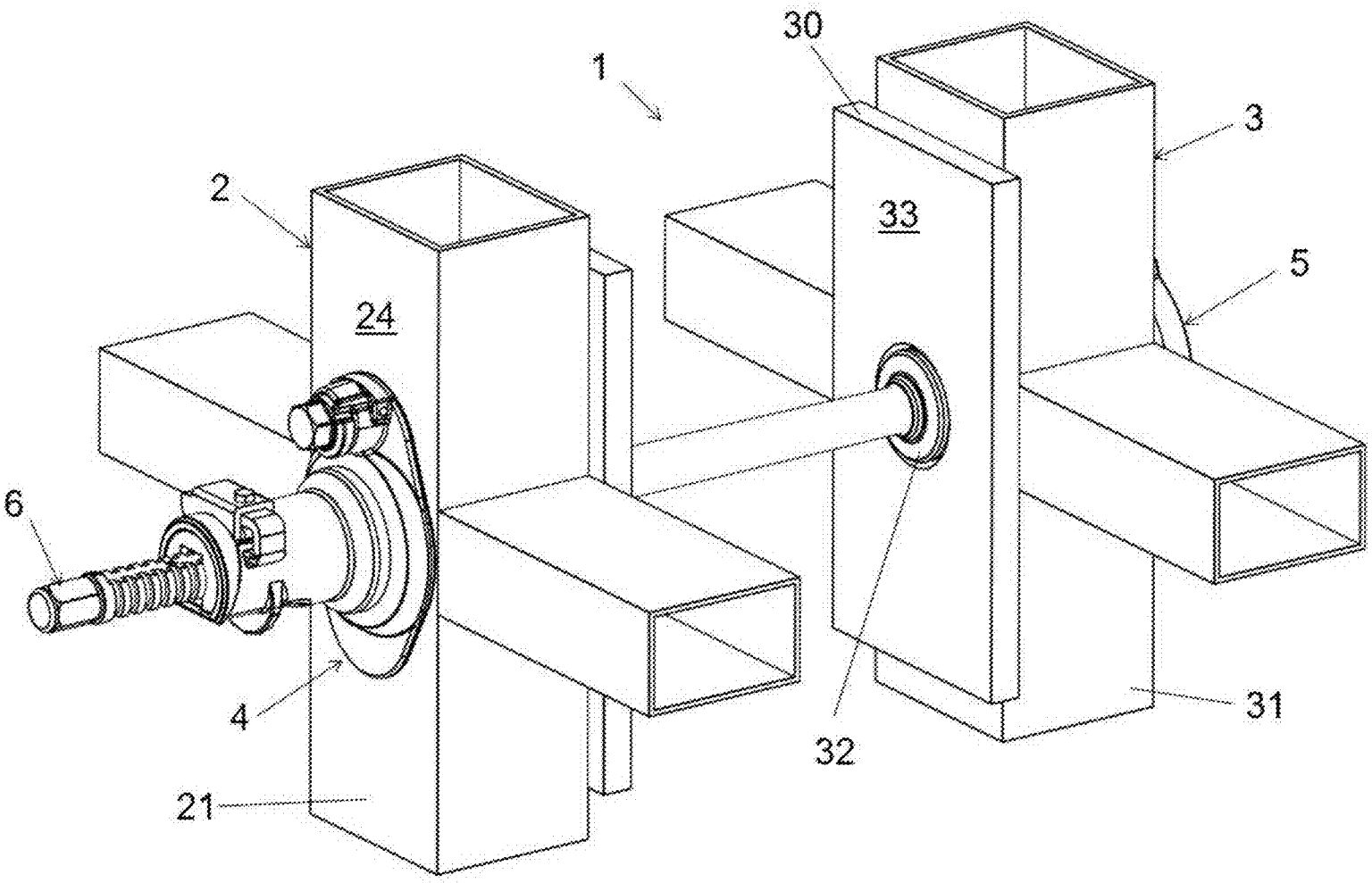
FIG. 1 shows a perspective view of a vertical formwork according to the one embodiment.
Figure 2:
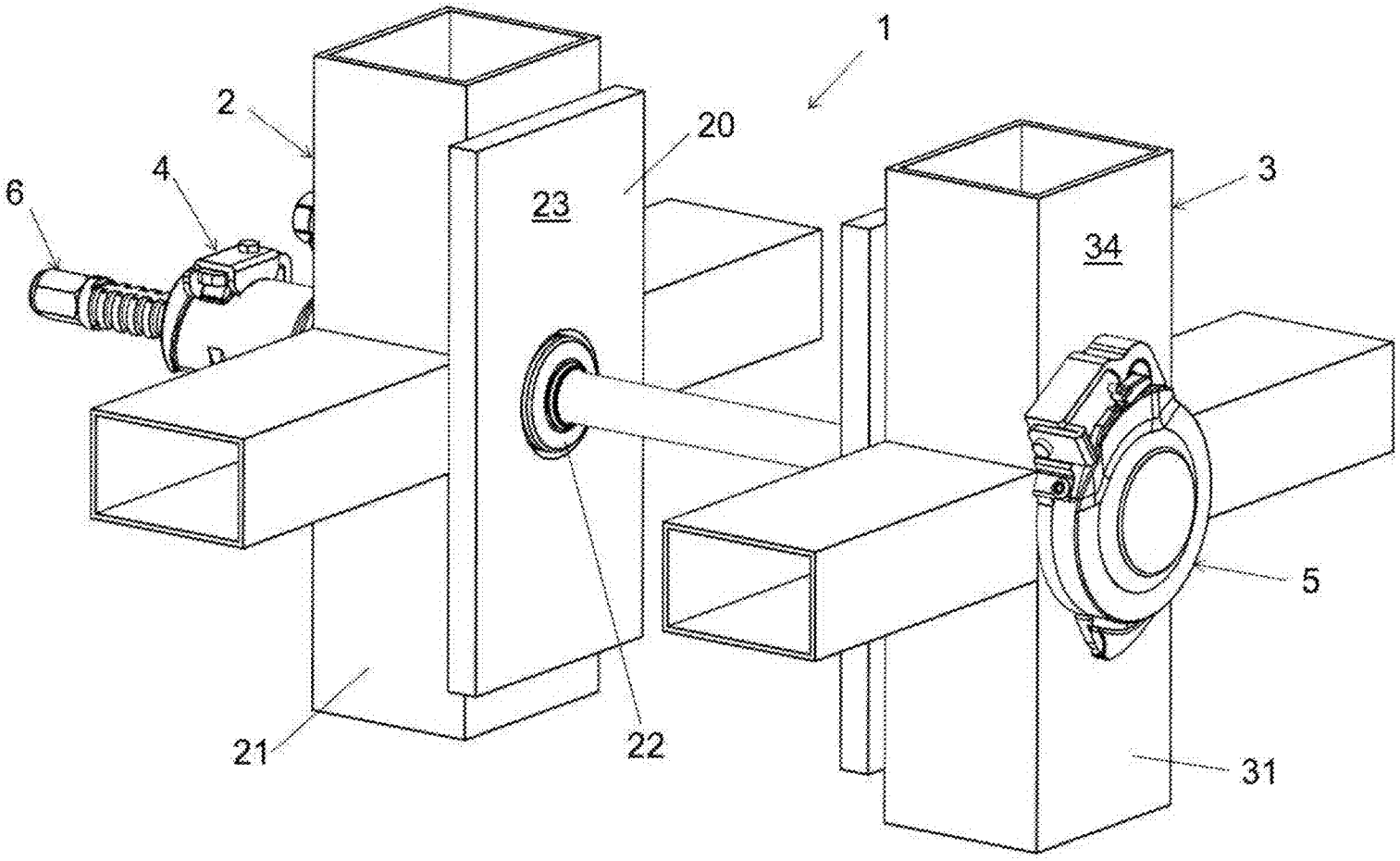
FIG. 2 shows a second perspective view of the vertical formwork of FIG. 1.
Figure 3:
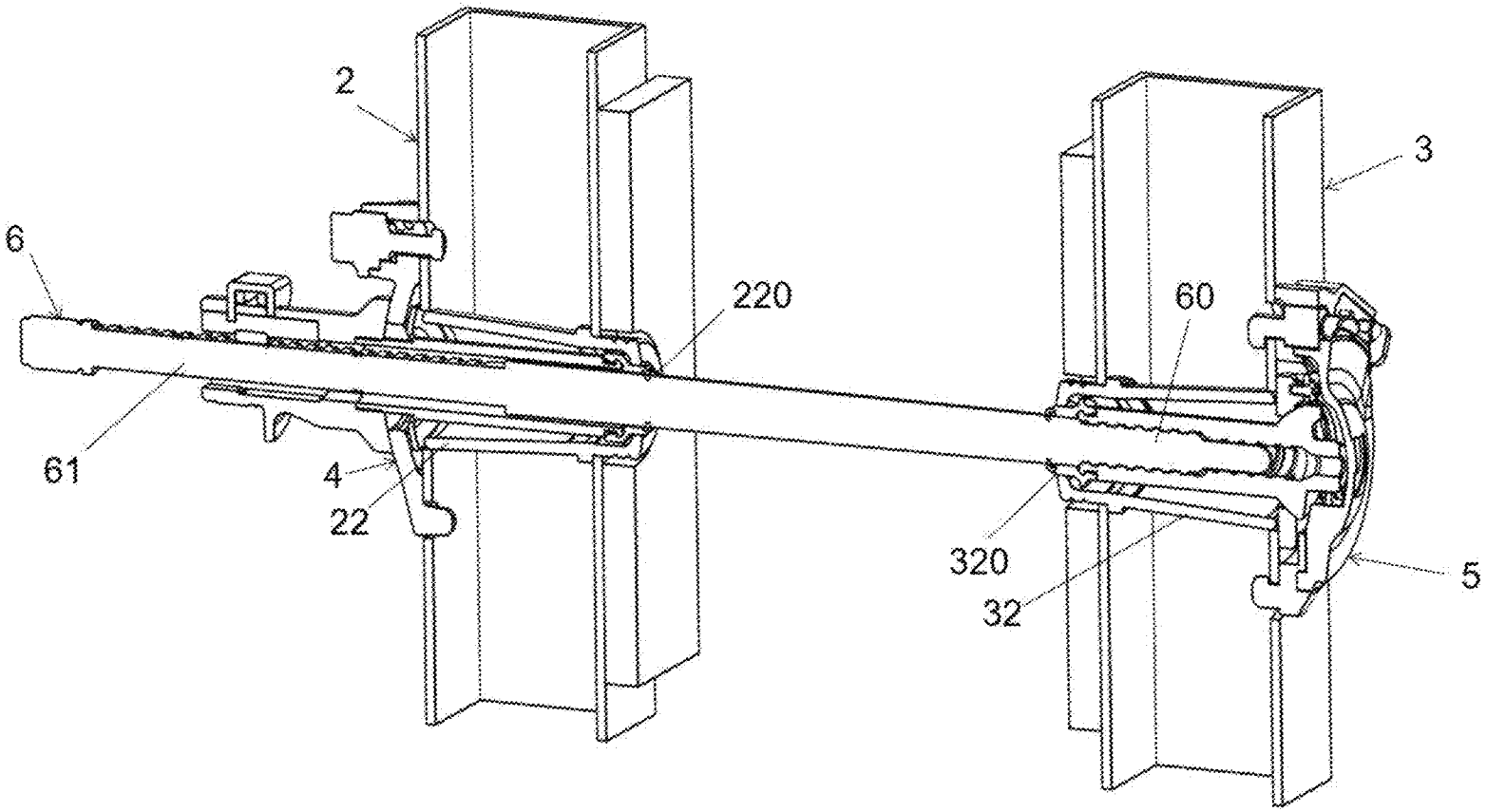
FIG. 3 shows a section view of the vertical formwork of FIG. 1.

FIGS. 1 to 3 show an embodiment of a vertical formwork. The vertical formwork 1 comprises a front formwork panel 2 and a rear formwork panel 3 which are arranged facing one another. The vertical formwork 1 also comprises an anchor assembly comprising a front anchor element 4 and a tie rod 6. The tie rod 6 comprises a first end 61 which is housed in the front anchor element 4, and a threaded end 60 which is fixed to a rear anchor 5. The front anchor element 4 is fixed to the front formwork panel 2, whereas the rear anchor 5 is fixed to the rear formwork panel 3.

The vertical formwork 1 of this embodiment is a vertical formwork 1 configured for being adjusted from one face, i.e., the tie rod 6 is fixed from one side of the vertical formwork 1. In vertical formworks 1 of this type, the rear anchor 5 is fixed to the rear formwork panel 3 before the front formwork panel 2 and the rear formwork panel 3 are arranged in the concreting position. Once the front formwork panel 2 and the rear formwork panel 3 are positioned in the concreting position, the operator is located in the front portion, fixing the threaded end 60 of the tie rod 6 to the rear anchor 5 and the first end 61 of the tie rod 6 to the front anchor element 4 which is fixed to the front formwork panel 2. In the context of the invention, the front portion will be considered the portion where the operator fixing the tie rod 6 is located. Therefore, the front formwork panel 2 is the formwork panel arranged on the side of the operator, and the rear formwork panel 3 is the formwork panel facing said front panel 2. Similarly, the front anchor element 4 is the anchor fixed to the front formwork panel 2, and the rear anchor 5 is the anchor fixed to the rear formwork panel 3. Furthermore, the inner face 23 and 33 of the formwork panel 2 and 3, respectively, is the face suitable for being arranged in contact with the concrete and the outer face 24 and 34 of the formwork panel 2 and 3 is the face opposite the inner face 23 and 33.

In this embodiment, the front formwork panel 2 comprises a structure 21, a board 20 fixed to said structure 21, and a housing extending from the outer face 24 to the inner face 23 in which a bushing 22 is arranged, said bushing 22 going through said structure 21 and said board 20. The bushing 22 forms a housing in which part of the front anchor element 2 is housed. The bushing 22 has an entry opening which is arranged at the same level as the outer face 24 of the front formwork panel 2 and an exit opening 220 which is arranged at the same level as the inner face 23 of the formwork panel, the diameter of the exit opening 220 being less than the diameter of the entry opening. Preferably, the board 20 is made of wood and the structure 21 and the bushing 22 are made of metal.

In this embodiment, the configuration of the rear formwork panel 3 is the same as the configuration of the front formwork panel 2, and they can therefore be used interchangeably. For the sake of clarity, the formwork panels are only partially depicted in the drawings.

In other embodiments, depending on the dimensions of the formwork panel, each formwork panel can comprise a plurality of housings, a respective anchor and bushing being arranged in each of them, such that two facing formwork panels can be fixed to one another through a plurality of tie rods fixed to said anchors.

Figure 4:
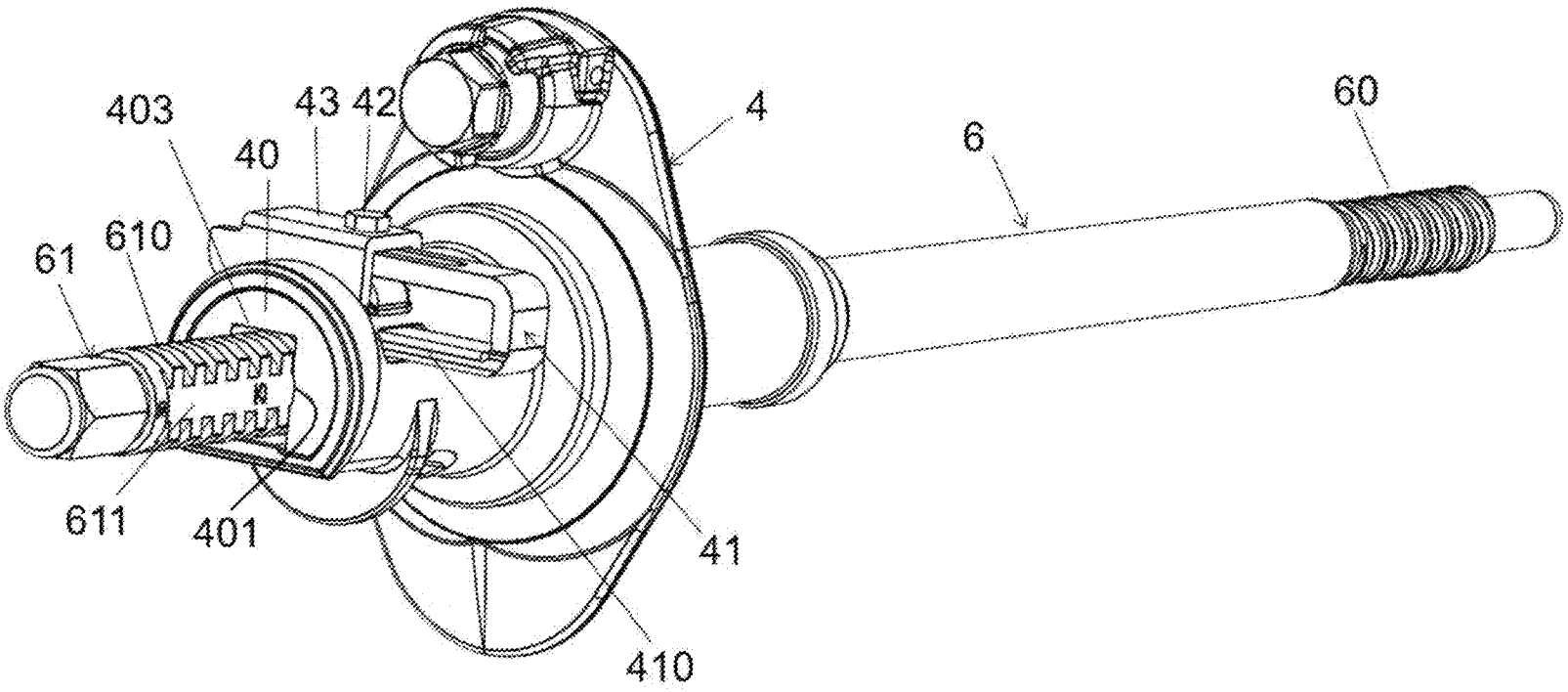
FIG. 4 shows a perspective view of the anchor assembly of the vertical formwork of FIG. 1.

FIG. 4 shows the anchor assembly of this embodiment. As mentioned above, the anchor assembly comprises the front anchor element 4 and the tie rod 6. The tie rod 6 comprises a first end 61 which is housed in said front anchor element 4, the front anchor element 4 and the first end 61 of the tie rod 6 being configured for fixing said front anchor element 4 in different axial positions of the first end 61 of the tie rod 6. The same tie rod 6 can thereby be used to carry out different wall thickness. The wall thickness is the distance at which the inner faces 23 and 33 of the front formwork panel 2 and the rear formwork panel 3 are arranged. Preferably the first end 61 of the tie rod 6 comprises a plurality of marks, such as numbers, for example, which refer to different wall thickness, such that it is much easier for the operator to know in which axial position of the first end 61 of the tie rod 6 should the anchor element 4 be fixed. In this embodiment, the first end 61 of the tie rod 6 comprises reference numbers every five centimeters.

The front anchor element 4 comprises a fitting part 40 comprising a housing 400 in which the first end 61 of the tie rod 6 is arranged. The housing 400 of the fitting part 40 comprises at least one grooved face 401 and 402, and the first end 61 of the tie rod 6 comprises at least one grooved face 610 and at least one planar face 611.

Therefore, when the tie rod 6 is arranged in a fitting angular position in which the planar face 611 of the tie rod and the grooved face 401 and 402 of the fitting part 40 are arranged facing one another, the tie rod 6 can move axially with respect to the fitting part 40, and when the tie rod is arranged in a fixing angular position in which the grooved face 610 of the tie rod 6 and the grooved face 401 and 402 of the fitting part 40 engage with one another, the tie rod 6 cannot move axially with respect to the fitting part 40.

The combination of the grooved face 401 and 402 of the fitting part 40, and the planar face 611 and the grooved face 610 of the first end 61 of the tie rod 6, provides a fast and comfortable wall thickness adjustment system based on three simple movements consisting of a first rotation of the tie rod 6 to position it in the fitting angular position, axial movement of the front anchor element 4 to the desired position and a second rotation of the tie rod 6 to position it in the fixing angular position.

The front anchor element 4 also comprises blocking means configured for blocking the rotation of the tie rod 6 with respect to the fitting part 40 when the tie rod 6 is arranged in the fixing angular position In this embodiment, the blocking means is configured for externally blocking the rotation of the tie rod 6 with respect to the fitting part 40 when the tie rod 6 is arranged in the fixing angular position. To that end the blocking means comprise a stop 410 which, in a blocking position, is arranged facing the planar face 611 of the tie rod 6 in the housing 400 of the fitting part 40.

Figure 9:
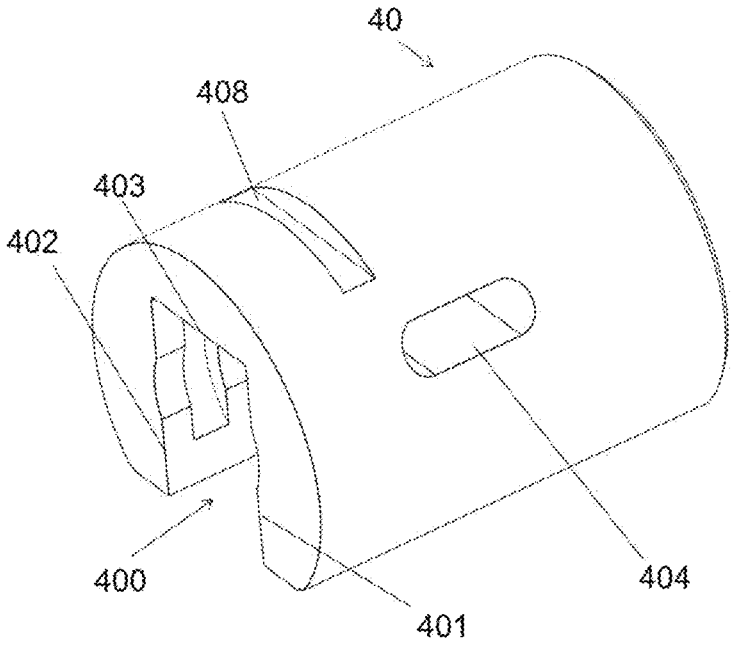
FIG. 9 shows a perspective view of the fitting element of the front anchor element of the anchor assembly of FIG. 4.
Figure 10:
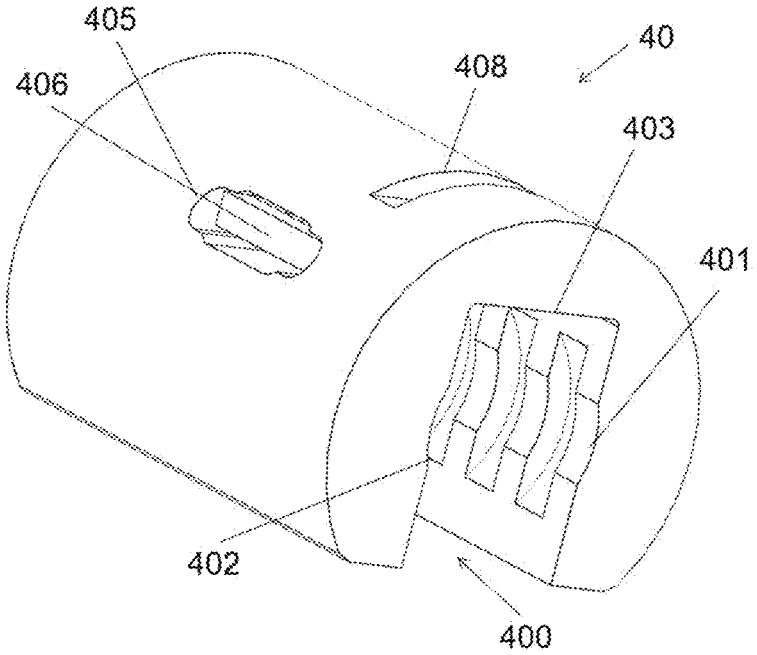
FIG. 10 shows a second perspective view of the fitting element of FIG. 9.
Figure 11:
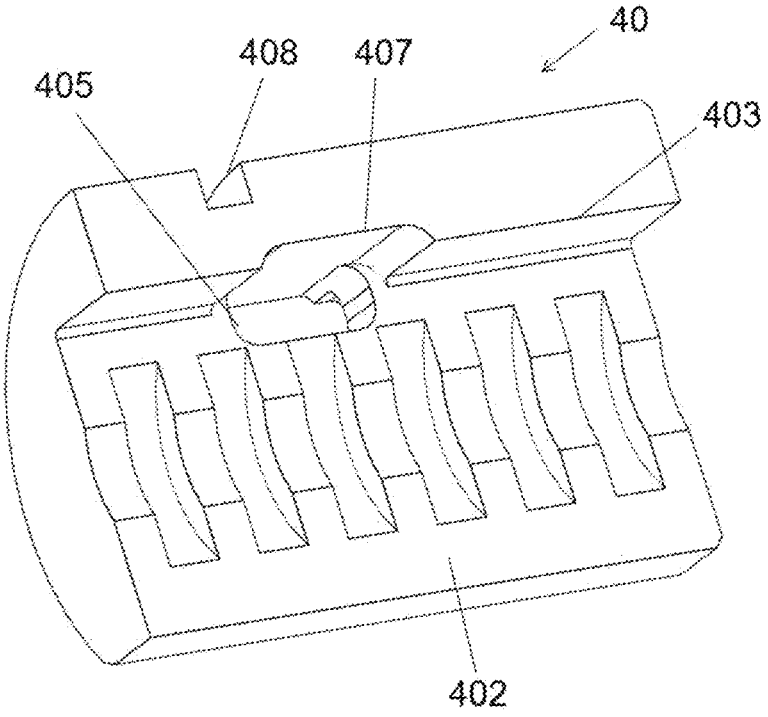
FIG. 11 shows a section view of the fitting element of FIG. 9.

The fitting part 40 of this embodiment, shown in detail in FIGS. 9 to 11, comprises a housing with two grooved faces 401 and 402 and a planar face 403 which is arranged between the two grooved faces 401 and 402.

Figure 12:
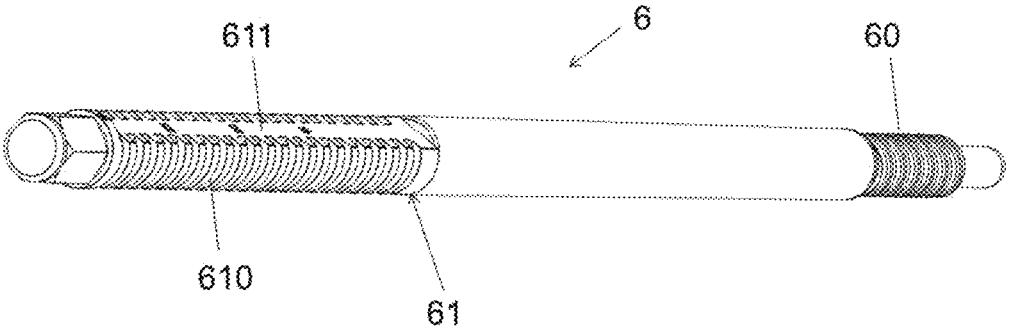
FIG. 12 shows a perspective view of the tie rod of the anchor assembly of FIG. 4.

The tie rod 6 of this embodiment, shown in detail in FIG. 12, comprises a first end 61 with two planar faces 611 opposite one another and two grooved faces 610 opposite one another.

The grooved faces 610 of the tie rod 6 and the grooved faces 401 and 402 of the housing 400 of the fitting part 40 comprise a series of transverse grooves arranged in the axial direction, said grooved faces 610, 401 and 402 being complementary, such that in the fixing angular position said grooved faces 610, 401 and 402 engage with one another, i.e., each grooved face of the tie rod 610 engages with a respective grooved face 401 and 402 of the housing 400 of the fitting part 40.

Figure 5:
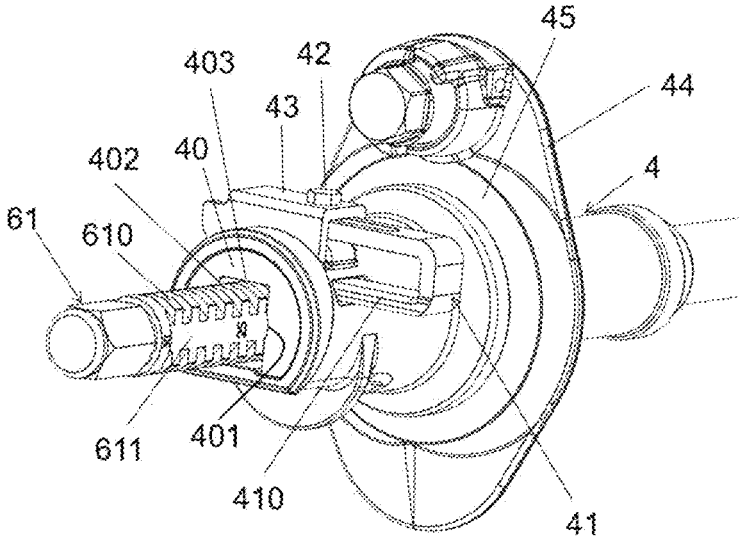
FIG. 5 shows a partial view of the anchor assembly of FIG. 4, the tie rod being arranged in a fitting angular position.
Figure 6:
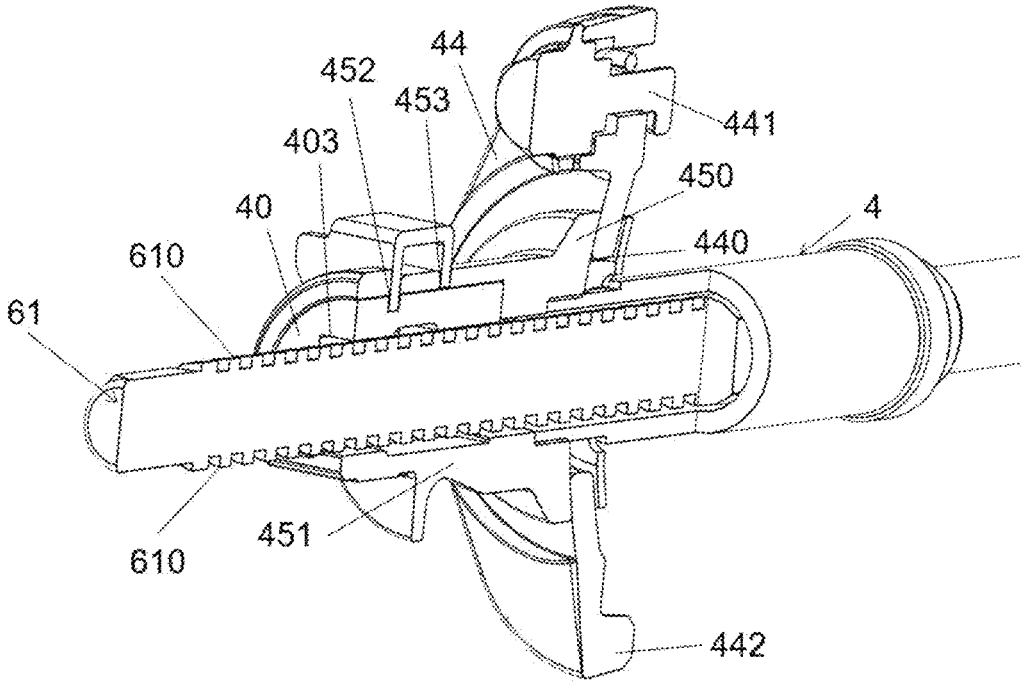
FIG. 6 is a section view of FIG. 5.

FIGS. 5 and 6 partially show the anchor assembly when the tie rod 6 is arranged in a fitting angular position. In said fitting angular position, the planar faces 611 of the tie rod 6 and the grooved faces 401 and 402 of the fitting part 40 are arranged facing one another. The tie rod 6 can thereby move axially with respect to the fitting part 40.

Figure 7:
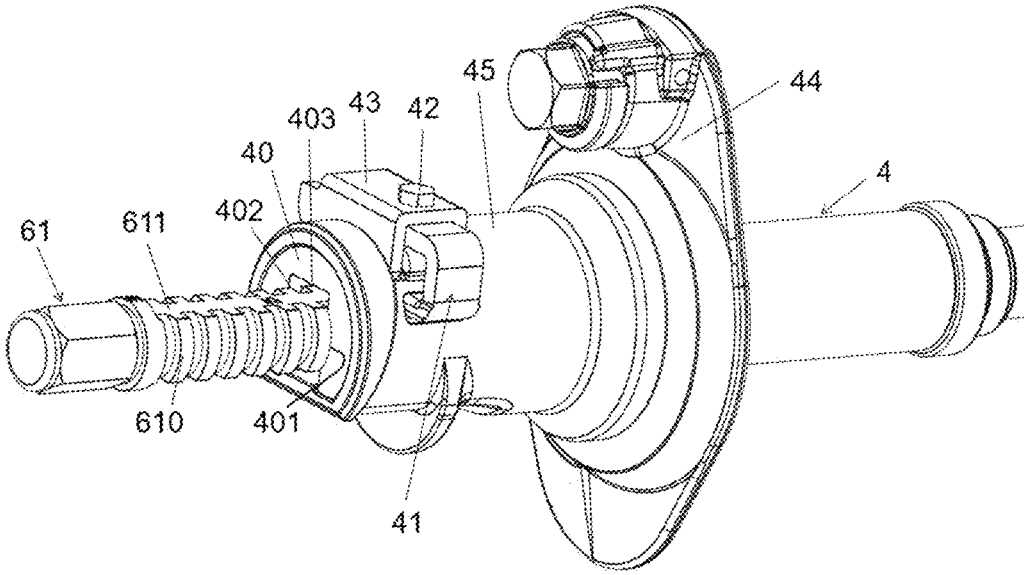
FIG. 7 shows a partial view of the anchor assembly of FIG. 4, the tie rod being arranged in a fixing angular position.
Figure 8:
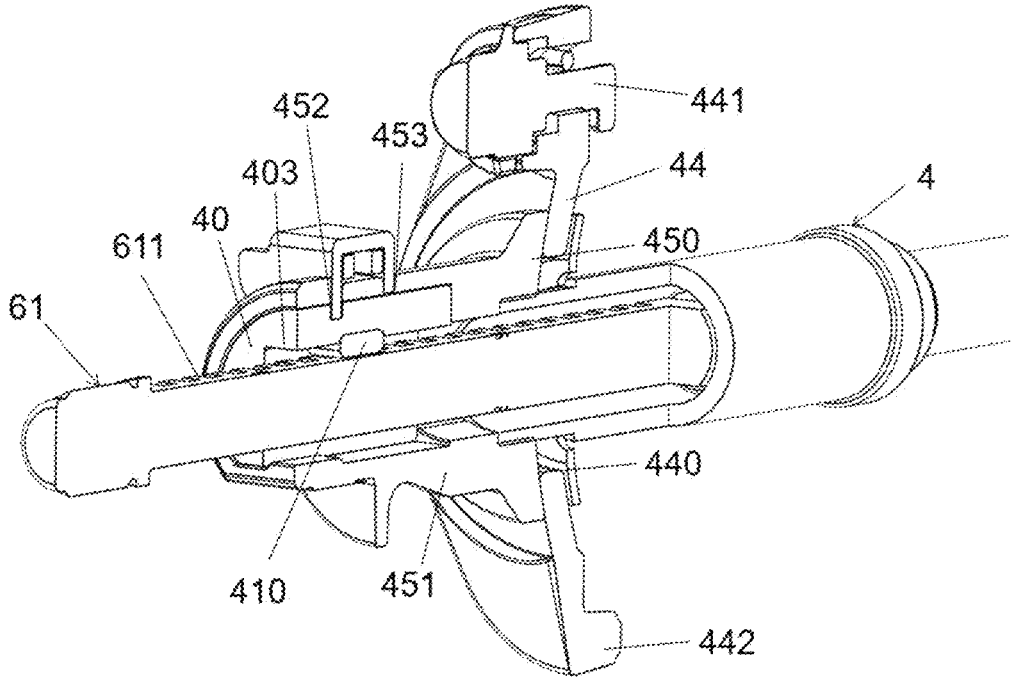
FIG. 8 is a section view of FIG. 7.

FIGS. 7 and 8 partially show the anchor assembly when the tie rod 6 is arranged in a fixing angular position. In said fixing angular position, the grooved faces 610 of the tie rod 6 and the grooved faces 401 and 402 of the fitting part 40 engage with one another, and therefore the tie rod 6 cannot move axially with respect to the fitting part 40.

FIGS. 7 and 8 also show the stop 410 in a blocking position, being arranged in the housing 400 of the fitting part 40, in the gap formed between one of the planar faces 611 of the tie rod 6 and the planar face 403 of said housing 400. In this embodiment, the stop 410 of the blocking means is supported on the planar face 611 of the tie rod 6 when it is arranged in the blocking position.

In other possible embodiments, the stop of the blocking means does not have to be supported on the planar face of the tie rod and can have any shape. In order for the stop to perform its function, it is enough for it to be arranged in the housing of the fitting part taking up at least part of the gap formed between one of the planar faces of the tie rod and the planar face of said housing, the gap taken up by the stop being enough to prevent the tie rod from being able to rotate to the fitting angular position.

As can be seen in the drawings, in this embodiment the rotation of the tie rod 6 required to transition said tie rod 6 from the fitting angular position to the fixing angular position and vice versa, is ninety degrees.

Figure 13:
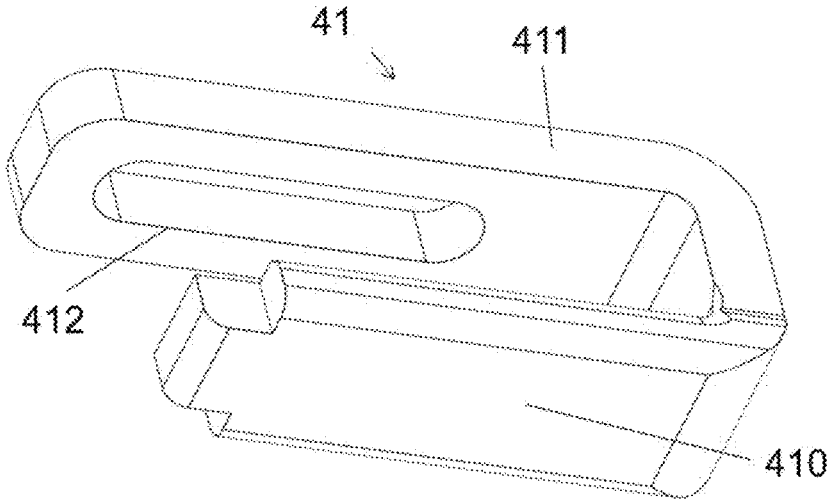
FIG. 13 shows a perspective view of the blocking pin of the front anchor element of the anchor assembly of FIG. 4.
Figure 14:
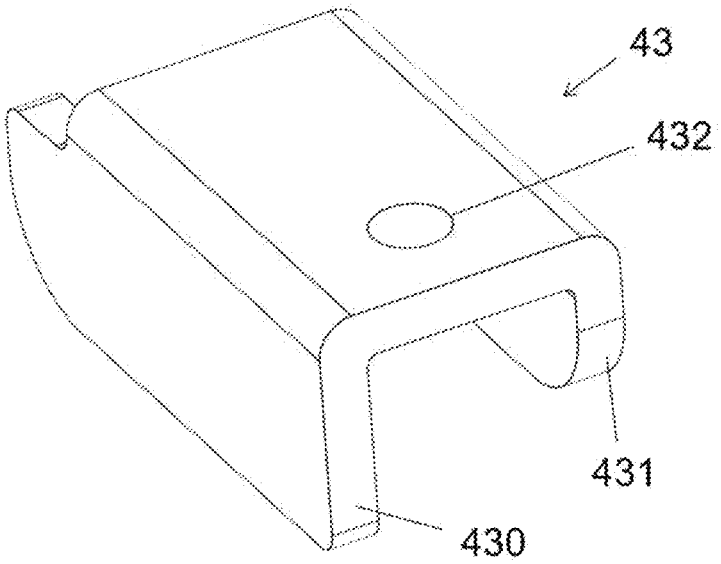
FIG. 14 shows a perspective view of the support part of the front anchor element of the anchor assembly of FIG. 4.

In this embodiment, the blocking means comprise a blocking pin 41 shown in detail in FIG. 13. The blocking pin incorporates the aforementioned stop 410. The blocking pin 41 is movably coupled to the front anchor element 4, being configured for being arranged in a first position, shown in FIG. 5, in which the stop 410 is arranged in a release position and in a second position, shown in FIG. 7, in which the stop 410 is arranged in the blocking position. The fact that the blocking pin 41 is coupled to the front anchor element 4 means that said part cannot be detached from the rest of the front anchor element 4, and therefore makes the operator's work easier as they need not be concerned about missing any parts when assembling formwork.

The fitting part 40 of this embodiment, shown in detail in FIGS. 9 to 12, comprises a first side opening 404 communicated with the housing 400, the stop 410 of the blocking pin 41 being slidably arranged in said first side opening 404.

In this embodiment, the fitting part 40 comprises a second side opening 405 communicated with the housing 400 and facing the first side opening 404. Furthermore, the fitting part 40 comprises a magnet 406 arranged in said second side opening 405. The magnet 406 is therefore arranged close to the stop 410 in the blocking position. Since the stop 410 comprises a ferromagnetic material, when the blocking pin 41 is arranged in the second position, the magnet 410 retains the blocking pin 41 in said position. The magnet 406 assures that once the stop 410 is arranged in the blocking position, said stop 410 will not accidentally move to the release position, and therefore prevents the risk of the tie rod 6 being able to be arranged in the fitting angular position if this is not desired.

In other possible embodiments, the fitting part can lack a second opening and therefore the magnet can be arranged elsewhere in the housing, provided that it complies with the condition that said magnet is arranged close to the stop in the blocking position.

In other possible embodiments, the fitting part can comprise other retaining means for assuring that the blocking pin 41 is retained in the second position.

In this embodiment, the planar face 403 of the fitting part 40 comprises a guide groove 407 which is arranged between the first side opening 404 and the second side opening 405 of the fitting part 40. Said guide groove 407 is configured for guiding the stop 410 when moving from the release position to the blocking position and vice versa.

The blocking pin 41 of this embodiment, shown in detail in FIG. 13, comprises an outer arm 411 attached to the stop 410. The outer arm 411 is guided by guiding means arranged in the front anchor element 4, said guiding means limiting the travel of the blocking pin 41 between the first position and the second position.

In this embodiment, the outer arm 411 of the blocking pin 41 comprises a longitudinal groove 412, and the guiding means comprise a guide pin 42 coupled to the front anchor element 4 going through said longitudinal groove 412 of the blocking pin 41.

The guiding means of this embodiment also comprise a support part 43 fixed to the front anchor element 4, the guide pin 42 being arranged housed in a hole 432 of said support part 43.

The front anchor element 4 of this embodiment comprises a dome plate 44 comprising a spherical-shaped central section comprising an opening 440. The front anchor element 4 also comprises a body 45 with a housing in which the fitting part 40 is arranged and which the first end 61 of the tie rod 6 goes through. The body 45 comprises a tubular portion 451 in which the housing of the fitting part 40 is arranged, and a spherical portion 450 after said tubular portion 451, which is arranged in the opening 440 of the dome plate 44. The coupling of the spherical portion 450 of the body 45 and the opening 440 of the dome plate 44 allows orienting the body 45 with respect to the dome plate 44.

In this embodiment, the tubular portion 451 of the body comprises a first fixing groove 452 and a second fixing groove 453, the first fixing groove 452 coinciding at the same level as a fixing groove 408 of the fitting part 40 when said fitting part 40 is housed in the housing of the tubular portion 451 of the body 45.

The support part 43 comprises an upper wall in which the hole 432 is arranged and a first side wall 430 and a second side wall 431 extending perpendicularly from the longitudinal sides of said upper wall. The free end of the first side wall 430 is configured for being housed in the first fixing groove 452 of the tubular portion 451 of the body 45 and in the fixing groove 408 of the fitting part 40, whereas the free end of the second side wall 431 is configured for being housed in the second groove 453 of the tubular portion 451 of the body 45.

Figure 15:
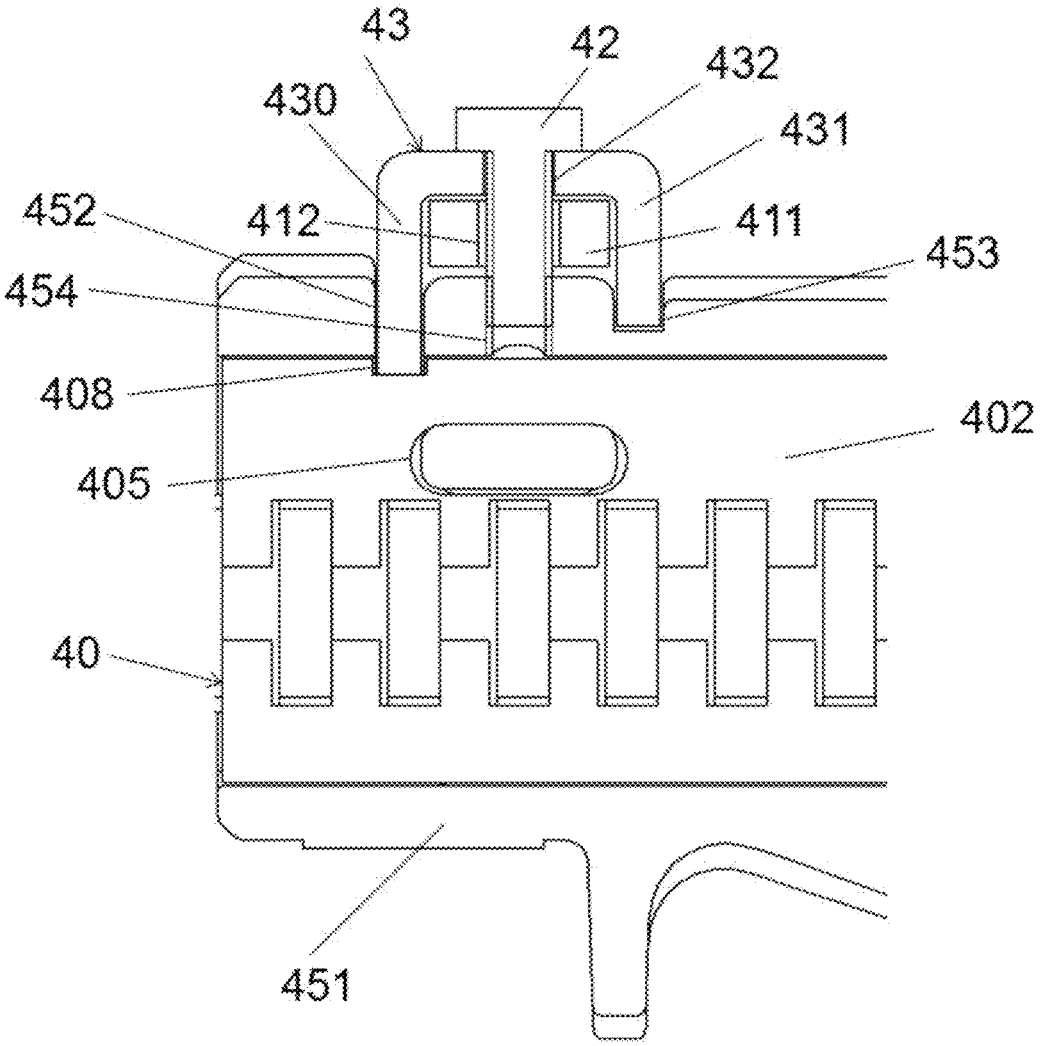
FIG. 15 is a detailed section view of the front anchor element of the anchor assembly of FIG. 4.

Furthermore, in this embodiment the tubular portion 451 of the body 45 comprises a threaded hole 454, shown in detail in FIG. 15, said threaded hole 454 coinciding at the same level as the hole 432 of the support part 43 when the first side wall 430 is housed in the first fixing groove 452 of the tubular portion 451 of the body 45 and in the fixing groove 408 of the fitting part 40, and the free end of the second side wall 431 is housed in the second groove 453 of the tubular portion 451 of the body 45. Furthermore, in this embodiment the guide pin 42 is a screw that is configured for going through the hole 432 of the support part 43 and the longitudinal groove 412 of the outer arm 411 of the blocking pin 41, and to be screwed into the threaded hole of the tubular portion 451 of the body 45. So, when the guide pin 43 is screwed into the threaded hole 454 of the tubular portion 451 of the body 45, the fitting part 40 is retained inside the housing of the tubular portion 451 of the body 45.

In this embodiment, the dome plate 44 comprises a fixing key 441 and a pin 442 to fix the front anchor element 4 to the front formwork panel 2.

What is claimed is:

1. An anchor assembly for a vertical formwork comprising:

a front anchor element, a tie rod having a longitudinal axis and including a first end that is housed in the front anchor element, the first end of the tie rod having a first grooved face and a first planar face, the front anchor element and the first end of the tie rod being configured to fix the front anchor element in different longitudinal axial positions along a length of the first end of the tie rod, the front anchor element comprising a fitting part that includes a housing in which at least a portion of the first end of the tie rod is arranged, the housing of the fitting part including a first grooved face, when the tie rod is arranged in a fitting angular position, in which the first planar face of the tie rod and the first grooved face of the fitting part are arranged facing one another, the fitting part can slide between different axial positions with respect to the first end of the tie rod without the tie rod being rotated during the sliding of the fitting part, when the tie rod is arranged in a fixing angular position, in which the first grooved face of the tie rod and the first grooved face of the fitting part engage with one another, the fitting part cannot slide axially with respect to the first end of the tie rod as a result of the first grooved face of the tie rod and the first grooved face of the fitting part engaging one another; and a blocking element that is configured to block the rotation of the tie rod with respect to the fitting part when the tie rod is arranged in the fixing angular position.

2. The anchor assembly according to claim 1, wherein the blocking element includes a stop which, in a blocking position, is arranged facing a portion of the first planar face of the first end of the tie rod located inside the housing of the fitting part when the tie rod is arranged in the fixing angular position.

3. The anchor assembly according to claim 2, wherein the blocking element is a blocking pin incorporating the stop, the blocking pin being movably coupled to the front anchor element, the blocking pin movable between a first position in which the stop is arranged in a release position to permit rotation of the tie rod and a second position in which the stop is arranged in the blocking position to prevent rotation of the tie rod.

4. The anchor assembly according to claim 3, wherein the fitting part includes a first side opening communicated with the housing, the stop of the blocking pin being slidably arranged in the first side opening.

5. The anchor assembly according to claim 4, further comprising a magnet arranged on or in the fitting part at a location close to the stop when the blocking pin is in the second position, the stop comprising a ferromagnetic material such that when the blocking pin is arranged in the second position the magnet retains the blocking pin in the second position.

6. The anchor assembly according to claim 5, wherein the fitting part includes a second side opening communicated with the housing, the second side opening facing the first side opening, the magnet being arranged in the second side opening.

7. An anchor assembly according to claim 3, wherein the blocking pin includes an outer arm attached to the stop, the outer arm being guided with respect to the fitting part to limit the travel of the blocking pin between the first position and the second position.

8. The anchor assembly according to claim 7, wherein the outer arm of the blocking pin includes a longitudinal groove, the anchor assembly further including a guide pin coupled to the front anchor element and passing through the longitudinal groove.

9. The anchor assembly according to claim 8, further comprising a support part fixed to the front anchor element, the guide pin being coupled to the support part.

10. The anchor assembly according to claim 1, wherein the first grooved face of the tie rod includes a first series of grooves arranged side-by-side and transverse to the longitudinal axis of the tie rod, and the first grooved face of the housing of the fitting part includes a second series of transverse grooves arranged side-by-side and transverse to the longitudinal axis of the tie rod, the first grooved faces of the tie rod and housing being complementary such that in the fixing angular position the first grooved faces engage with one another.

11. The anchor assembly according to claim 1, wherein a rotation of the tie rod to transition from the fitting angular position to the fixing angular position is ninety degrees.

12. The anchor assembly according to claim 11, wherein the first end of the tie rod includes a second planar face and a second grooved face that are respectively located opposite the first planar face and a second grooved face of the tie rod, and the housing of the fitting part includes a second grooved face, when the tie rod is arranged in the fixing angular position the first and second grooved faces of the first end of the tie rod engage with the first and second grooved faces of the housing of the fitting part.

13. The anchor assembly according to claim 12, wherein the housing of the fitting part includes a planar face that is arranged between the first and second grooved faces of the housing, when the tie rod is arranged in the fixing angular position, the first planar face of the first end of the tie rod faces the planar face of the housing.

14. The anchor assembly according to claim 13, wherein the blocking element includes a stop which, in a blocking position, is arranged between the first planar face of the first end of the tie rod and the planar face of the housing of the fitting part.

15. The anchor assembly according to claim 14, wherein the blocking element is a blocking pin incorporating the stop, the blocking pin being movably coupled to the front anchor element, the blocking pin movable between a first position in which the stop is not arranged between the first planar face of the first end of the tie rod and the planar face of the housing of the fitting part and a second position in which the stop is arranged between the first planar face of the first end of the tie rod and the planar face of the housing of the fitting part.

16. The anchor assembly according to claim 14, wherein the planar face of the housing of the fitting part includes a guide groove for the stop.

17. A vertical formwork assembly comprising:

a front formwork panel, a rear formwork panel, a tie rod having a longitudinal axis and including a first end and a threaded second end, the first end of the tie rod having a first grooved face and a first planar face, a front anchor assembly in which the first end of the tie rod is housed, the front anchor assembly being fixed to the front formwork panel, the front anchor assembly and the first end of the tie rod being configured to fix the front anchor assembly in different longitudinal axial positions along a length of the first end of the tie rod, the front anchor assembly comprising a fitting part that includes a housing in which the first end of the tie rod is arranged, the housing of the fitting part including a first grooved face, when the tie rod is arranged in a fitting angular position, in which the first planar face of the first end of the tie rod and the first grooved face of the fitting part are arranged facing one another, the fitting part can slide between different axial positions with respect to the first end of the tie rod without the tie rod being rotated during the sliding of the fitting part, when the tie rod is arranged in a fixing angular position, in which the first grooved face of the first end of the tie rod and the first grooved face of the fitting part engage with one another, the fitting part cannot slide axially with respect to the first end of the tie rod as a result of the first grooved face of the first end of the tie rod and the first grooved face of the fitting part engaging one another;

a blocking element that is configured to block the rotation of the tie rod with respect to the fitting part when the tie rod is arranged in the fixing angular position; and a rear anchor assembly fixed to the rear formwork panel and fixed to the threaded second end of the tie rod.

18. The vertical formwork assembly according to claim 17, wherein the blocking element includes a stop which, in a blocking position, is arranged facing a portion of the first planar face of the first end of the tie rod located inside the housing of the fitting part when the tie rod is arranged in the fixing angular position.

19. The vertical formwork assembly according to claim 18, wherein the blocking element is a blocking pin incorporating the stop, the blocking pin being movably coupled to the front anchor element, the blocking pin movable between a first position in which the stop is arranged in a release position to permit rotation of the tie rod and a second position in which the stop is arranged in the blocking position to prevent rotation of the tie rod.

20. The vertical formwork assembly according to claim 19, wherein the fitting part includes a first side opening communicated with the housing, the stop of the blocking pin being slidably arranged in the first side opening.

* * * * *